United States Patent [19]

Baermann

[11] 4,419,644

[45] Dec. 6, 1983

[54] SWITCHABLE PERMANENT MAGNETIC HOLDING DEVICE

[75] Inventor: Horst Baermann, Rosrath, Fed. Rep. of Germany

[73] Assignee: Max Baermann GmbH, Bergisch-Gladbach, Fed. Rep. of Germany

[21] Appl. No.: 457,881

[22] Filed: Jan. 14, 1983

[51] Int. Cl.[3] ..... H01F 7/02

[52] U.S. Cl. ..... 335/288; 335/295

[58] Field of Search ..... 335/285, 288, 295, 303, 335/302, 306

[56] References Cited

U.S. PATENT DOCUMENTS 4,055,824 10/1977 Baermann ..... 335/288
4,250,478 2/1981 Cardong et al. ..... 335/295 X
4,251,791 2/1981 Yanagisawa et al. ..... 335/295 X

FOREIGN PATENT DOCUMENTS 1121242 1/1962 Fed. Rep. of Germany .

*Primary Examiner*—George Harris
*Attorney, Agent, or Firm*—Body, Vickers & Daniels

[57] ABSTRACT

A permanent magnet energized holding device for holding of, or onto, ferromagnetic objects and readily switchable between "on" and "off" positions, has outer and inner cup-shaped pole shoe members of good magnetically conductive material concentrically nested in spaced apart relation one inside the other with their rim edges or pole faces lying in a common plane. A ring-shaped stationary permanent magnet is fixed in the space between the peripheral side walls of the cup members, and the cup members and stationary magnet are correspondingly divided magnetically into two portions at the same points therearound by non-magnetic mediums. A rotatable permanent magnet sandwiched between the base end walls of the cup members is rotatable therebetween by an operating shaft or other actuating means to switch the holding device between its "on" and "off" positions. The two magnets are magnetized in the direction of their smallest dimension or thickness, with portions of each having opposite magnetic polarity. The magnetically divided portions of the stationary magnet are arranged to magnetize the pole portions of the cup members with opposite polarity. In one rotative position of the rotatable magnet, the magnetic polarity thereof coincides with that of the stationary magnet and reinforces the magnetic force thereof so as to increase the magnetic flux in the respective pole shoe members, while in another rotative position its magnetic polarity is in opposition to the magnetic polarity of the stationary magnet and reduces the magnetic flux in the pole shoe members of the device.

14 Claims, 6 Drawing Figures

SWITCHABLE PERMANENT MAGNETIC HOLDING DEVICE

BACKGROUND OF THE INVENTION

This invention relates to an "on-off" switchable permanent magnetic holding device for holding of or onto ferromagnetic objects.

A permanent magnetic holding device for holding ferromagnetic objects such as intended workpieces is already known, as disclosed in U.S. Pat. No. 4,055,824, which comprises at least two pairs of plate-shaped pole shoes of material with high magnetic permeability, each pole shoe pair being divided by a nonmagnetic medium, such as brass. Sandwiched between the two pairs of plate-shaped pole shoes are one or several plate-shaped rigid permanent magnets each having a corresponding centrally located circular recess in each of which a disc-shaped permanent magnet is turnably positioned. The rigid and the turnable magnets are magnetized to provide each magnet with two pole pairs of opposite magnetic polarity on each face thereof and with alternating polarity in axial direction, i.e., on the opposite flat sides of the magnets.

With the permanent magnets as thus arranged, in the switched on rotative position of the turnable magnet in the holding device, similar pole regions of the rigid and turnable permanent magnets, i.e. regions of the same magnetic polarity, lie adjacent to and magnetize the two magnetically divided pole shoes of each pole plate to provide a magnetic holding force thereat, while in the switched off rotative position of the turnable magnet dissimilar pole regions of the rigid and turnable magnets, having opposite magnetic polarity, lie adjacent to the pole shoes of each pole plate and thus leave them unmagnetized and devoid of any magnetic holding force.

With permanent magnetic holding devices as described above, at least two of the holding surfaces thereof, i.e., one pair of poles shoes, ordinarily remain unused as, for instance, because of the presence outwardly adjacent the faces of such pole shoe pair of an actuating or control knob for rotating the turnable permanent magnet. Furthermore, the holding surfaces of the rigid magnet are located diametrically outward relative to the turnable permanent magnets with this type of holding device, resulting in an unavoidably large structure height or dimension.

SUMMARY OF THE INVENTION

The present invention contemplates a new and improved "on-off" switchable permanent magnetic holding device which overcomes all of the above referred to problems and others and provides a magnetic holding device of simple, economical, and compact construction and affording a relatively high magnetic holding force relative to its overall size.

Briefly stated, in accordance with one aspect of the invention, the magnetic holding device comprises outer and inner hollow or cup-shaped body members of magnetically good conductive material such as soft iron, for example, which are open to one side and concentrically positioned or nested in spaced relation one inside the other with their peripheral rim edges, which form the pole faces of the members from which the lines of magnetic force emerge, all lying in one plane or on one article holding level. The hollow body members are identically divided at corresponding diametrical regions therearound, by respective non-magnetic mediums such as brass or air, into at least two separate pole parts, and a stationary first permanent magnet or corresponding magnetically divided form is fixedly disposed in the space between the side walls of the hollow bodies and magnetizes the walls thereof. A rotatable second permanent magnet, disposed in the space between the base end walls of the hollow body members, is rotatably movable therebetween relative to the first permanent magnet. The permanent magnets are so magnetized, through their respective thickness between the side and base end walls of the hollow body members, as to magnetize the opposing adjacent pole faces of the body members with poles of alternating magnetic polarity and cause the poles of the second magnet, in one rotative or "switched-on" position thereof, to reinforce and increase the magnetic flux in the body members and, in a second rotative or "switched-off" position, to oppose and reduce the magnetic flux in the body members. The hollow body members open to one side may be cup-, ring-, or rail-shaped with a U-shaped cross section or square.

In a surprising manner, the magnetic holding device according to the invention fully utilizes the maximum inserted volume of permanent magnetic material without leakage, taking into account the flat design thereof, in that all lines of magnetic force emerging from the pole faces onto the ferromagnetic surface onto which the holding device is placed for holding, are fully effective. This results in unusually high holding strength for the simple design of holding device.

Furthermore, in the embodiment of the invention suggested herein, relatively inexpensive permanent magnetic materials such as plastic-bonded injection-molded and/or flexible permanent magnets on a barium-, strontium- or lead-ferrite basis, can be employed therein. If magnetically higher grade permanent magnet materials are used, such as rare-earth cobalt magnets, then only a relatively small volume of permanent magnet material is required.

The holding device according to the invention may be used universally for holding onto ferromagnetic bases. For example, the holding device may be used for supporting an antenna or lamp holder on vehicles whereby switching on of the device after placement on the vehicle body avoids scratching or marring of the paint surface. Of course, there are other possibilities for use of the holding device, such as a clamping element for machining of workpieces, for holding measuring instruments, or for other purposes.

In an advantageous embodiment of the invention, particularly in the case of a holding device in rail- or ring-shaped form, several turnable permanent magnets can be positioned between the outer and the inner hollow bodies, which together are inversely adjustable from the "on" to the "off" position by means of a rack or toothed ring.

The turnable permanent magnets may be disc-shaped, square or rectangular and they can be made of either sintered or injection-molded, plastic-bonded permanent magnet material. The stationary magnets may comprise a strip of flexible permanent magnetic material made, for example, of barium-, strontium- and/or lead-ferrite powder particles embedded in a rubbery flexible binder. These magnets also may be made of rare-earth cobalt magnet material.

In order to avoid scratching or marring of the holding surface of the ferromagnetic base when the holding device is placed thereon, the interior space of the hollow inner body member of the device may be filled with an elastic rubber material which projects slightly above or beyond the holding level of the device and is compressed when the device is magnetically attracted to and held against the holding surface of the ferromagnetic base.

The principal object of the invention is to provide an "on-off" switchable permanent magnetic holding device, for magnetic holding of or onto ferromagnetic objects, which is of very flat design and all the pole faces of which simultaneously deploy the holding effect on a holding surface to provide a high holding strength.

Another object of the invention is to provide an "on-off" switchable permanent magnetic holding device of the above mentioned type which is of simple, economical and easily assembled flat-shaped form.

Still another object of the invention is to provide a permanent magnetic holding device of the above mentioned type which will not scratch or mar the painted or polished surface of a ferromagnetic object onto which the device is applied, when the device is switched between its on and off positions.

Further objects and advantages of the invention will become apparent from the following detailed description of a preferred cup-shaped embodiment thereof taken in conjunction with the accompanying drawings.

BRIEF DESCRIPTION OF THE DRAWINGS IN THE DRAWINGS

DESCRIPTIVE OF THE PREFERRED EMBODIMENTS

Figure 1:
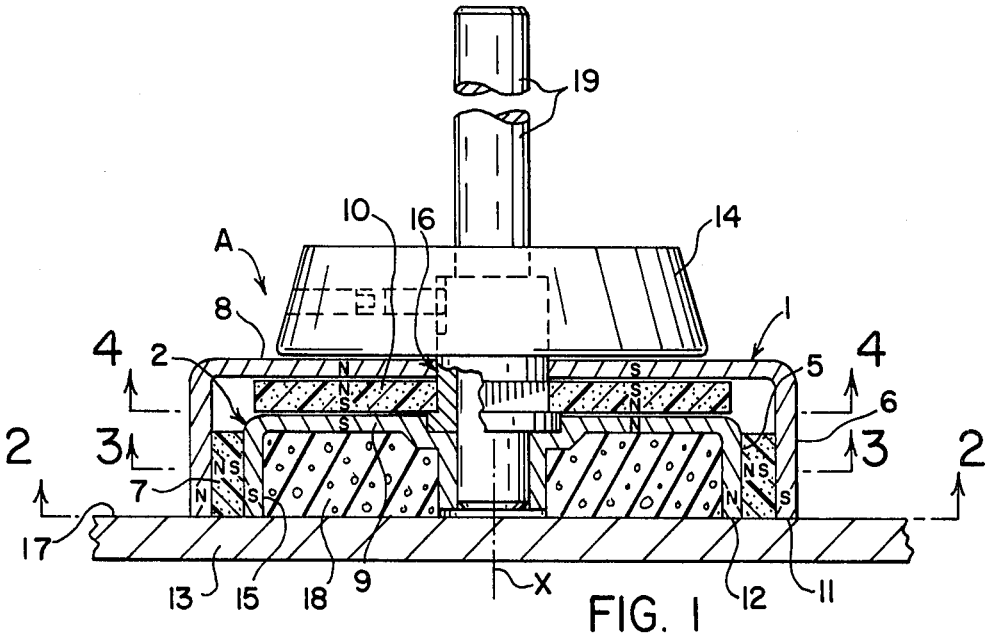
FIG. 1 is a vertical section through a permanent magnetic holding device comprising the invention.

Referring to the drawings wherein the showings are for the purpose of illustrating a preferred embodiment of the invention only and not for the purpose of limiting same, the permanent magnetic holding device A according to the invention comprises an outer cup-shaped hollow body member 1 and an inner cup-shaped hollow body member 2, both of magnetically good conductive material such as soft iron, which are concentrically positioned or nested in spaced relation one inside the other about a common center axis X, with their open sides facing outwardly in the same direction, as shown in FIG. 1.

The cup-shaped hollow body members 1 and 2 are each magnetically divided at the same points thereabout, i.e., at corresponding diametrical regions, into at least two magnetically separated pole parts or shoes by respective non-magnetic mediums 3, 4 such as air gaps or brass divider strips fitted between the pole parts of the respective body members 1, 2. A stationary permanent magnet 7 of strip-like form is fixedly positioned in the annular space between the concentrically disposed annular side walls 5 and 6 of the inner and outer hollow body members 2, 1 and is likewise magnetically divided, at the same diametrical points or regions as the two hollow body members 1, 2, by non-magnetic mediums such as by air gaps or brass spacer plugs 7'. The permanent magnetic strip 7 may comprise, for example, a flexible permanent magnet material such as barium-, strontium-, and/or lead-ferrite powder particles embedded in a rubbery flexible binder. The magnet 7 is magnetized in the direction of its smallest thickness, i.e., its thickness between the annular side walls 5, 6 of the hollow body members 1, 2. The poles of the magnet 7 and the body members 1, 2 are indicated in the drawings by the letters N and S.

Figure 2:
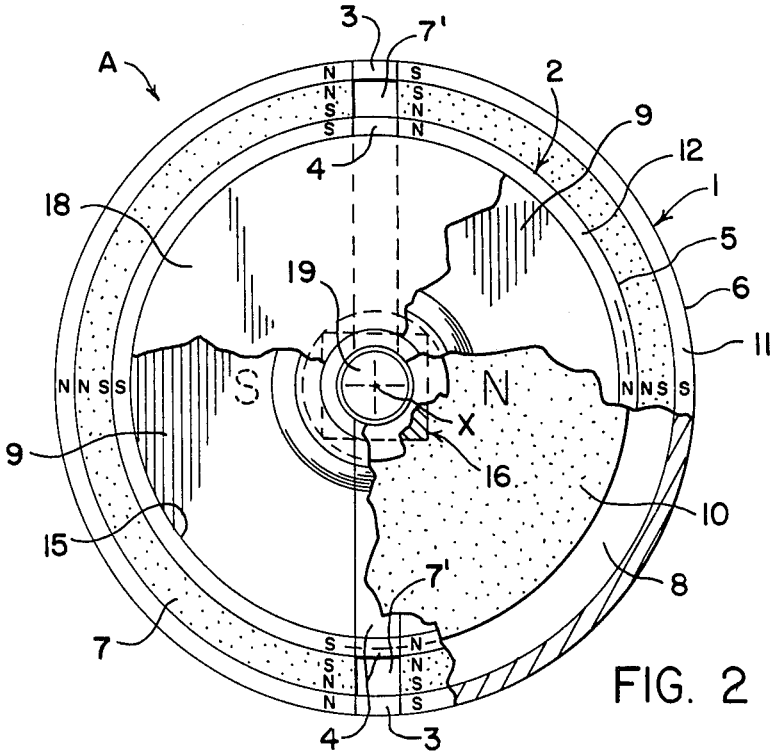
FIG. 2 is a view of the pole face or holding surface side of the holding device of FIG. 1, with portions thereof shown broken away.
Figure 3:
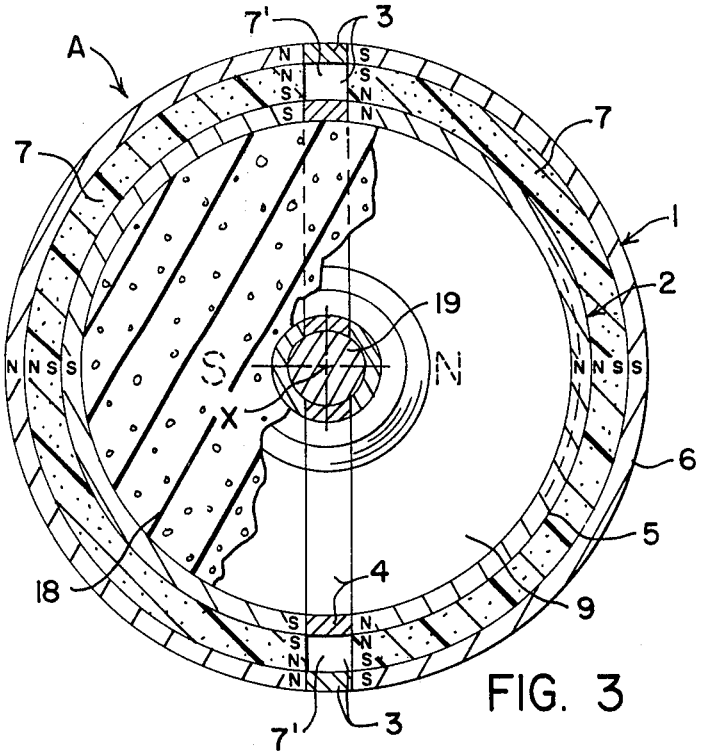
FIG. 3 is a sectional view on the line 3—3 of FIG. 1.

As shown in FIGS. 1 and 2, the permanent magnet strip 7 is so magnetized that, in the right-hand half of the nested cup-shaped body members 1 and 2, a south pole S of the permanent magnetic strip 7 lies against the inner circumferential surface of, and thus magnetizes with a corresponding south pole S, the annular side wall 6 of the outer cup-shaped body member 1, while a north pole N of the permanent magnetic strip 7 lies against the outer circumferential surface of, and thus magnetizes with a corresponding north pole N, the annular side wall 5 of the inner cup-shaped body member 2. The permanent magnetic strip 7 likewise magnetizes the left hand half of the nested body members in a similar but reversed polarity manner, a north pole N of the permanent magnetic strip 7 lying against the inner circumferential surface of, and thus magnetizing with a corresponding north pole N, the annular side wall 6 of the outer body member 1, while a south pole S of the permanent magnetic strip 7 lies against the outer circumferential surface of, and thus magnetizes with a corresponding south pole S, the annular side wall 5 of the inner body member 2.

Figure 4:
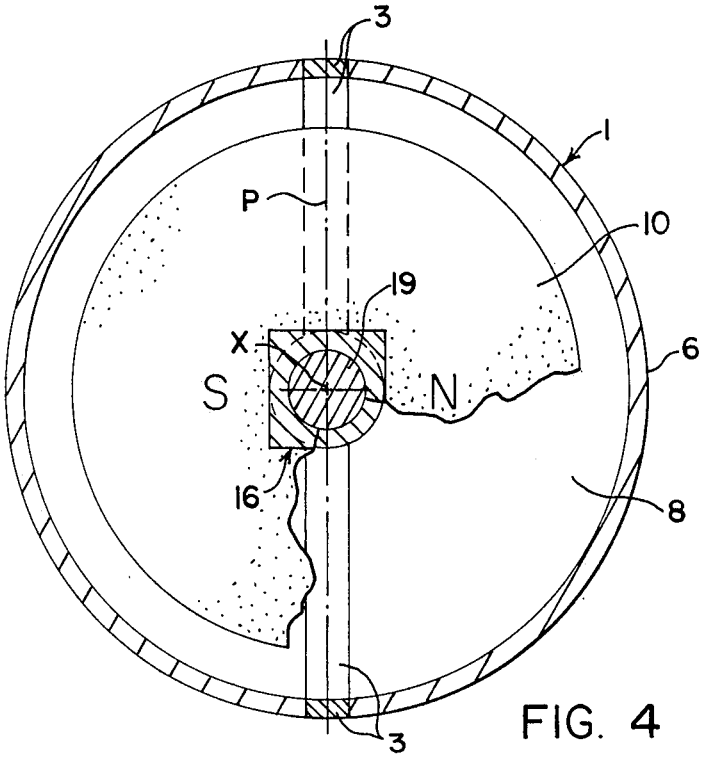
FIG. 4 is a sectional view on the line 4—4 of FIG. 1.

Concentrically positioned flatwise between the flat base end walls 8, 9 of the body members 1, 2, and mounted for rotation about the center axis X of the device A, is a turnable disc-shaped permanent magnet 10 the flat opposite side surfaces of which are in flatwise magnetizing engagement with the opposing flat surfaces of the base end walls 8, 9. The disc-shaped magnet 10 is diametrically divided by a neutral zone, indicated by the dotted parting line P in FIG. 4, into two half sections one of which is magnetized through the smallest thickness of the magnet, i.e., axially thereof, in opposite direction to the other half section. The poles of the magnet 10 are again indicated in the drawing by the letters N and S.

The turnable, disc-shaped magnet 10 is provided with a centrally located square-shaped recess into which a banded sleeve 16 suitably of brass or other non-magnetic material and of like exterior shape engages and mates to rotatively interlock the sleeve 16 and magnet 10. The sleeve 16 is rotatably mounted in the base end walls 8, 9 of the body members 1, 2 for axial rotation about the center axis X of the device A. For the purpose of rotating the magnet 10 to switch the holding device A on and off, the sleeve 16 is provided with a manual operating part such as a knurled control knob 14 suitably fastened thereon. A rod 19, e.g., an antenna rod, may be engaged in the sleeve 16.

In FIG. 1, the holding device A is shown as being switched on. In the right hand half of the holding device A in FIG. 1, a south pole of the turnable magnet 10 lies against the inner surface of the right hand half of the base end wall 8 of the outer body member 1 which is magnetized with a south pole by the stationary magnet 7, while a north pole of the turnable magnet 10 lies against the outer surface of the right hand half of the base end wall 9 of the inner body member 2 which is magnetized with a north pole by the stationary magnet 7. In the left hand half of the switched-on device as shown in FIG. 1, these magnetic poled conditions are completely reversed. In the switch-on condition (FIG. 1) of the holding device A, therefore, the magnetic flux induced in the body members 1, 2 by the turnable magnet 10 complements, and thus increases, the magnetic flux induced therein by the stationary magnet 7, and a very high magnetic holding strength then results.

As can be seen in FIGS. 1 and 2, poles of alternating polarity are located on the respective opposite half-ring-shaped pole or holding surfaces 11, 12 of the body members 1, 2 so that a ferromagnetic part or object 13 is attracted and held thereonto since the magnetic lines of force emitted by these pole surfaces 11, 12 then short circuit through the object 13.

Figure 5:
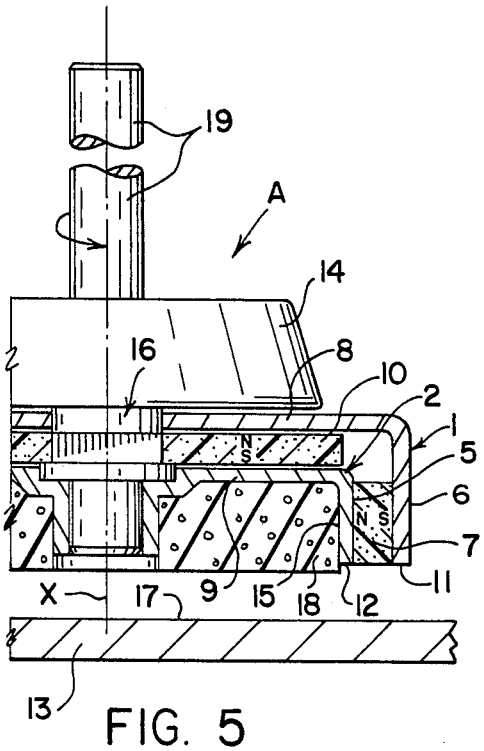
FIG. 5 is a fragmentary view/similar to FIG. 1 showing the holding device switched off and slightly separated from the holding object; and, FIG. 6 is an exploded perspective view of the holding device.
Figure 6:
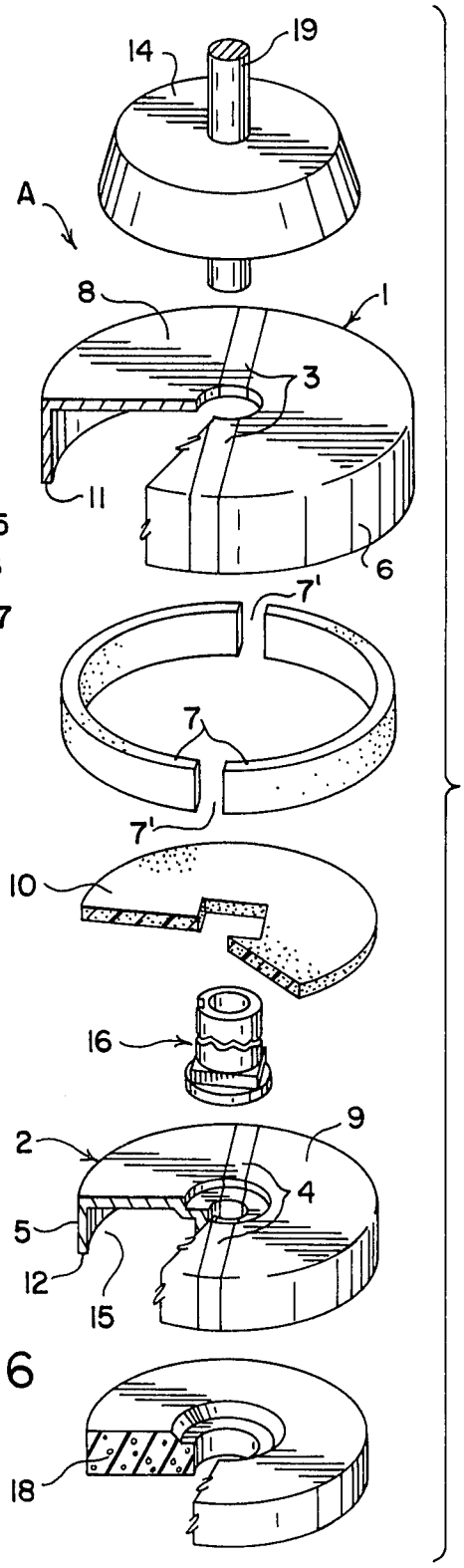

If the turnable magnet 10 is rotated by 180° from its FIG. 1 position by turning the operating knob 14, the holding device A then is placed in its switched-off condition, as shown in FIG. 5 because the poles, and the magnetic flux of the magnets 7, 10 then short circuit through the halves of the outer and inner body members 1, 2 so that the magnetic flux is, in other words, compensated, i.e., the magnetic flux of the turnable magnet 10 opposes and neutralizes the magnetic flux induced in the body members 1, 2 by the stationary magnet 7. In this case, then, no lines of magnetic force emerge from, and thus no magnetic holding force is present at the pole or holding surfaces 11, 12, so that the holding device A and the ferromagnetic object 13 previously held thereto then can be readily separated from each other.

The inner space 15 of the cup-shaped inner body member 2 of the holding device A may be filled with a rubber elastic compressible material 18 in such a manner as to project slightly beyond the holding level or plane 17 of the device, as shown in FIG. 5, so that when the device is placed on a ferromagnetic holding object 13, e.g., on a vehicle body, the pole surfaces 11, 12 do not immediately come into contact with the object. When the holding device A is switched on, the high magnetic holding strength thereof overcomes the slight cushioning effect of and compresses the rubber elastic material 18 and is then fully effective to attract the pole surfaces 11, 12 onto the holding object 13 and hold the device A in place thereon. In this manner, scratching or marring of the surface of the ferromagnetic part or object 13, when the holding device A is placed thereon, is avoided.

It will be appreciated that the holding device according to the invention is not limited to the particular embodiment illustrated in the drawings and described hereinabove. The cup-shaped hollow body members 1, 2 could, for example, be magnetically divided or separated crosswise into four segment-shaped sections. In this case, the turnable magnet 10 would be magnetized in the direction of its smallest thickness, i.e., in its axial thickness direction, to form four segment-shaped pole regions. The permanent magnetic strip 7 fixed between the annular side wall walls 5, 6 of the body members 1, 2 also would be magnetically divided in such case into four segment-shaped sections magnetized in the direction of their smallest thickness, i.e., their thickness between the side walls 5, 6 of the body members 1, 2, with alternating poles. In this case, a turning angle of only 90° for the turnable magnet 10 would be required to switch the holding device A from on to off position.

Having thus described the invention, it is claimed:

1. An on-off switchable permanent magnetic holding device for releasably holding of or onto ferromagnetic articles, said device comprising first and second pole shoes in the form of outer and inner hollow body members of magnetically conductive material and open to one side, said hollow body members being supported in fixed concentrically nested relation one within the other with their open sides facing in the same direction and their respective peripheral side walls and base end walls disposed in spaced relation to each other and their rim edge pole faces disposed in a common article-holding plane, each of said body members being identically separated at corresponding diametrical regions thereof by respective non-magnetic mediums into at least two separated pole parts, a stationary first permanent magnet of strip-like form fixedly disposed in the space between and magnetizing the said side walls of said body members and magnetically separated by non-magnetic mediums into at least two separate parts at diametrical regions corresponding to the diametrically separated regions of said body members, and a rotatable second permanent magnet disposed in the space between and magnetizing the said base end walls of said body members, said rotatable magnet being magnetized across the thickness thereof between the said base end walls with at least two pole pairs of alternating magnetic polarity to cause the poles of said rotatable second magnet, in one relative rotative position thereof, to reinforce and increase the magnetic flux in said body members and, in a second relative rotative position, to oppose and reduce the magnetic flux in said body members.

2. A magnetic holding device as defined in claim 1 wherein the said first magnet is magnetized in a direction across the said thickness thereof with pole pairs of opposite magnetic polarity and with the pole pairs of adjacent said separated pole parts of reversed magnetic polarity, and said second magnet is magnetized in a direction across the said thickness thereof with pole pairs of opposite magnetic polarity and with the poles of adjacent said pole pairs of said second magnet, corresponding to the said separated parts of said first magnet, being of reversed magnetic polarity.

3. A magnetic holding device as defined in claim 1 wherein the said hollow body members are cup-shaped with a U-shaped cross section.

4. A magnetic holding device as defined in claim 1 wherein the said hollow body members are ring-shaped with a U-shaped cross section.

5. A magnetic holding device as defined in claim 1 wherein the said hollow body members are rail-shaped with a U-shaped cross-section.

6. A magnetic holding device as defined in claim 1 wherein the said rotatable magnet is fixed on an operating sleeve rotatably mounted in said body members.

7. A magnetic holding device as defined in claim 1 wherein a plurality of said rotatable permanent second magnets are positioned between the said base end walls of said outer and inner hollow body members which rotatable magnets together are inversely rotatably adjustable from their said pole shoe magnetic reinforcing "on" position to their pole shoe magnetic opposing "off" position by actuating means comprising a rack or toothed ring.

8. A magnetic holding device as defined in claim 1 wherein the said rotatable second magnet is disc-shaped.

9. A magnetic holding device as defined in claim 1 wherein the said rotatable second magnet is of rectangular shape.

10. A magnetic holding device as defined in claim 1 wherein the said rotatable second magnet comprises a material of the group consisting of sintered or injection-molded plastic-bonded permanent magnetic material.

11. A magnetic holding device as defined in claim 1 wherein the said rotatable and stationary permanent magnets comprise a material of the group consisting of barium ferrite, strontium ferrite, or lead ferrite, and/or rare-earth cobalt magnetic material.

12. A magnetic holding device as defined in claim 1 wherein the inner space of said inner pole shoe body member is filled with a rubber elastic material which projects slightly beyond the holding plane of said outer and inner pole shoe body members.

13. A magnetic holding device as defined in claim 1 wherein the said outer and inner pole shoe body members and the said strip-like permanent magnet disposed between the side walls of said body members are separated by the respective said non-magnetic mediums into two corresponding half sections, and the said rotatable permanent magnet is magnetically divided diametrically into two corresponding pole pair half sections of reversed magnetic polarity relative to each other.

14. A magnetic holding device as defined in claim 1 wherein the said outer and inner pole body members and the said strip-like permanent magnet disposed between the side walls of said body members are diametrically separated by the said non-magnetic mediums respectively into four separate segment-shaped pole shoe parts and into four separate magnet sections, and the said rotatable permanent magnet is magnetically divided diametrically into four corresponding segment-shaped pole pair sections of alternating reversed magnetic polarity around the axis of rotation of said rotatable magnet.

* * * * *